United States Patent [19]

Paul

[11] Patent Number: 4,571,151

[45] Date of Patent: Feb. 18, 1986

[54] LIQUID INJECTION CONTROL IN MULTI-STAGE COMPRESSOR

[75] Inventor: Duane B. Paul, Leominster, Mass.

[73] Assignee: General Electric Company, Lynn, Mass.

[21] Appl. No.: 526,664

[22] Filed: Aug. 26, 1983

[51] Int. Cl.[4] ..... F01D 17/08

[52] U.S. Cl. ..... 415/1; 415/17; 415/47; 415/118; 60/653

[58] Field of Search ..... 415/1, 17, 26, 47, 50, 415/116, 118; 60/653

[56] References Cited

U.S. PATENT DOCUMENTS

| | | | |
|---|---|---|---|
| 1,400,813 | 12/1921 | Graemiger | 415/116 X |
| 2,549,819 | 4/1951 | Kane | 415/116 |
| 4,005,581 | 2/1977 | Aanstad | 415/17 X |

FOREIGN PATENT DOCUMENTS

| | | | |
|---|---|---|---|
| 128607 | 10/1980 | Japan | 415/118 |
| 26212 | 2/1982 | Japan | 415/118 |
| 101873 | 7/1922 | Switzerland | 415/116 |

*Primary Examiner*—Robert E. Garrett
*Assistant Examiner*—Joseph M. Pitko
*Attorney, Agent, or Firm*—James W. Mitchell

[57] ABSTRACT

Liquid injection into the interstage steam flow in a multi-stage compressor is controlled by calculating a saturation temperature of the fluid in the interstage and then controlling the liquid flow to reduce the incoming fluid temperature to a value a predetermined amount above the saturation temperature. In one embodiment, the fluid temperature is measured at the downstream end of the interstage conduit after it has been reduced by liquid injection. This measured temperature is used to compare with the calculated saturation temperature to determine whether to increase or decrease the liquid injection flow. In another embodiment of the invention, the fluid temperature is measured upstream of the liquid injection point. This measured fluid temperature is employed with a measured fluid mass flow rate and the calculated saturation temperature to calculate a desired liquid injection flow rate to reduce the temperature measured at the inlet to the desired amount of superheat at the entry to the following compressor stage. A measurement of the flow of injected liquid is compared with the calculated desired liquid flow to determine whether the injection liquid flow rate should be increased or decreased.

9 Claims, 5 Drawing Figures

LIQUID INJECTION CONTROL IN MULTI-STAGE COMPRESSOR

BACKGROUND OF THE INVENTION

The present invention relates to multi-stage compressors and, more particularly, to liquid injection control for reducing temperature increase in multi-stage turbocompressors.

As is well known, when work is done on a compressible fluid such as, for example, steam, the temperature of the compressible fluid increases. Four problems can result when the temperature increase is excessive:

1. The temperature difference between inlet and outlet may exceed the maximum temperature difference which can be handled in a single compressor body;
2. Commonly used materials must be replaced with exotic (expensive) materials to withstand the temperatures near the outlet;
3. The work required to compress the steam is unnecessarily increased; and
4. The steam delivered from the outlet may be excessively superheated (temperature above its saturation temperature) for satisfactory use in subsequent processes.

A six-stage turbocompresssor, for example, receiving steam at a temperature of, for example, about 180 degrees F. may increase the steam temperature to about 750 degrees F. in the process of compressing it to about 75 PSIA if no steps are taken to cool the steam in the process of compression. From a practical engineering standpoint, a temperature difference of this magnitude between inlet and outlet exceeds the temperature difference which can be sustained by a compressor in a single housing. One solution, of course, is splitting the compressor into two parts in separate housings. This solution, besides almost doubling the cost of such an apparatus, fails to solve the problems described in succeeding paragraphs.

Excessive temperatures in final compressor stages may obviate the use of common materials for gaskets and metals. For example, at a temperature of 750 degrees F., iron or carbon steel pump bodies and impellers may no longer offer a satisfactory service life and must be replaced with more costly materials which can withstand such an environment.

The work required to compress steam varies with its absolute temperature (Celsius or Rankine). If the final stage temperature is permitted to increase to 750 degrees F. (1210 degrees R.), the work required to compress the steam in that stage increases by over 30 percent compared to the work required to compress the steam at a temperature of about 430 degrees F. (890 degrees R.).

In most compressors, the desired result is an increase in pressure without an excessive temperature increase. In many applications, an excessive outlet temperature is undesirable. Specifications for a turbocompressor which requires an outlet pressure of about 75 PSIA normally limit the superheat of the outlet steam to from about 20 to about 100 degrees F. Normally, with an inlet steam temperature of, for example, about 177 degrees F., the compression process without interstage cooling would raise the temperature to about 750 degrees. This represents an unacceptable superheat of about 440 degrees F. Besides the fact that the superheat is unacceptably high, the other unwanted effects of excessive temperature discussed above are invoked.

In order to reduce the steam temperature in a multi-stage compressor, it is common to employ interstage cooling of various sorts. One type of interstage cooling that has been successfully used is heat exchange cooling wherein the heat is discharged to a cooling medium using a heat exchanger. Heat exchangers are relatively expensive devices which provide relatively poor control of the temperature entering a succeeeding stage.

Another cooling technique which has been successfully used in the past has been the injection of water into the steam between stages. The injected water decreases the steam temperature both by its cooler temperature and by absorption of heat of vaporization as it changes from water to steam. Water injection cooling is relatively inexpensive but it has some drawbacks. The flow path distance from the outlet of one stage of a multi-stage turbocompressor to the inlet of the next stage is relatively short. This short distance makes it difficult to obtain complete conversion of the injected water to steam. If the water is not completely vaporized, however, the remaining solid droplets impinging on the impeller blades of the succeeding stage may, at the least, cause pitting of the impeller blades and, in the extreme, may cause catastrophic failure of the impeller blades.

OBJECTS AND SUMMARY OF THE INVENTION.

Accordingly, it is an object of the present invention to provide means for interstage cooling in a multi-stage compressor which overcomes the drawbacks of the prior art.

More specifically, it is an object of the present invention to provide a liquid injection control which provides close control of the amount of superheat of the fluid fed to a succeeding stage.

It is a further object of the invention to provide a closed-loop control system for controlling the amount of water injected in an interstage water injection cooler based at least on the temperature and pressure of the interstage working fluid whereby the superheat of steam entering a succeeding stage is controlled to a value high enough to substantially completely vaporize the injected water but low enough to provide improved thermodynamic and mechanical efficiency of the apparatus.

It is a still further object of the invention to provide an apparatus for controlling the interstage water injection which controls the injection of water to a value which maintains a measured temperature of steam at a downstream end of the interstage a predetermined amount above a calculated steam saturation temperature based on a measured pressure of the steam in the interstage.

It is a still further object of the invention to provide an apparatus for controlling interstage water injection including means for calculating a desired rate of water injection based on a measured temperature in the interstage upstream of the water injection, a steam pressure in the interstage and a mass rate of flow of steam in the interstage and means for controlling an actual rate of water injection to be substantially equal to the desired rate.

According to an embodiment of the invention, there is provided apparatus for controlling interstage liquid injection into a fluid flow in a multi-stage compressor, comprising means for measuring a fluid pressure in the interstage, means for calculating a saturation temperature of the fluid based on the fluid pressure and, control means effective to control a flow rate of the liquid injection to a value which reduces a temperature of the fluid at a downstream end of the interstage to a predetermined amount above the saturation temperature.

According to a feature of the invention, there is provided a method for controlling interstage water injection into a steam flow in a multi-stage compressor, comprising measuring a pressure of steam in the interstage, calculating a saturation temperature of the steam based on the pressure, and controlling a flow rate of the water injection to a value effective to reduce a temperature of the steam at a downstream end of the interstage to a predetermined amount above the saturation temperature.

Briefly stated, the present invention provides control of liquid injection into the interstage fluid flow in a multi-stage compressor by calculating a saturation temperature of the fluid in the interstage and then controlling the liquid flow to reduce the incoming fluid temperature to a value a predetermined amount above the saturation temperature. In one embodiment, the fluid temperature is measured at the downstream end of the interstage conduit after it has been reduced by liquid injection. This measured temperature is used to compare with the calculated saturation temperature to determine whether to increase or decrease the liquid injection flow. In another embodiment of the invention, the fluid temperature is measured upstream of the liquid injection point. This measured fluid temperature is employed with a measured fluid mass flow rate and the calculated saturation temperature to calculate a desired liquid injection flow rate to reduce the temperature measured at the inlet to the desired amount of superheat at the entry to the following compressor stage. A measurement of the flow of injected liquid is compared with the calculated desired liquid flow to determine whether the injection liquid flow rate should be increased or decreased.

The above, and other objects, features and advantages of the present invention will become apparent from the following description read in conjunction with the accompanying drawings, in which like reference numerals designate the same elements.

Figures 1, 2, 4:
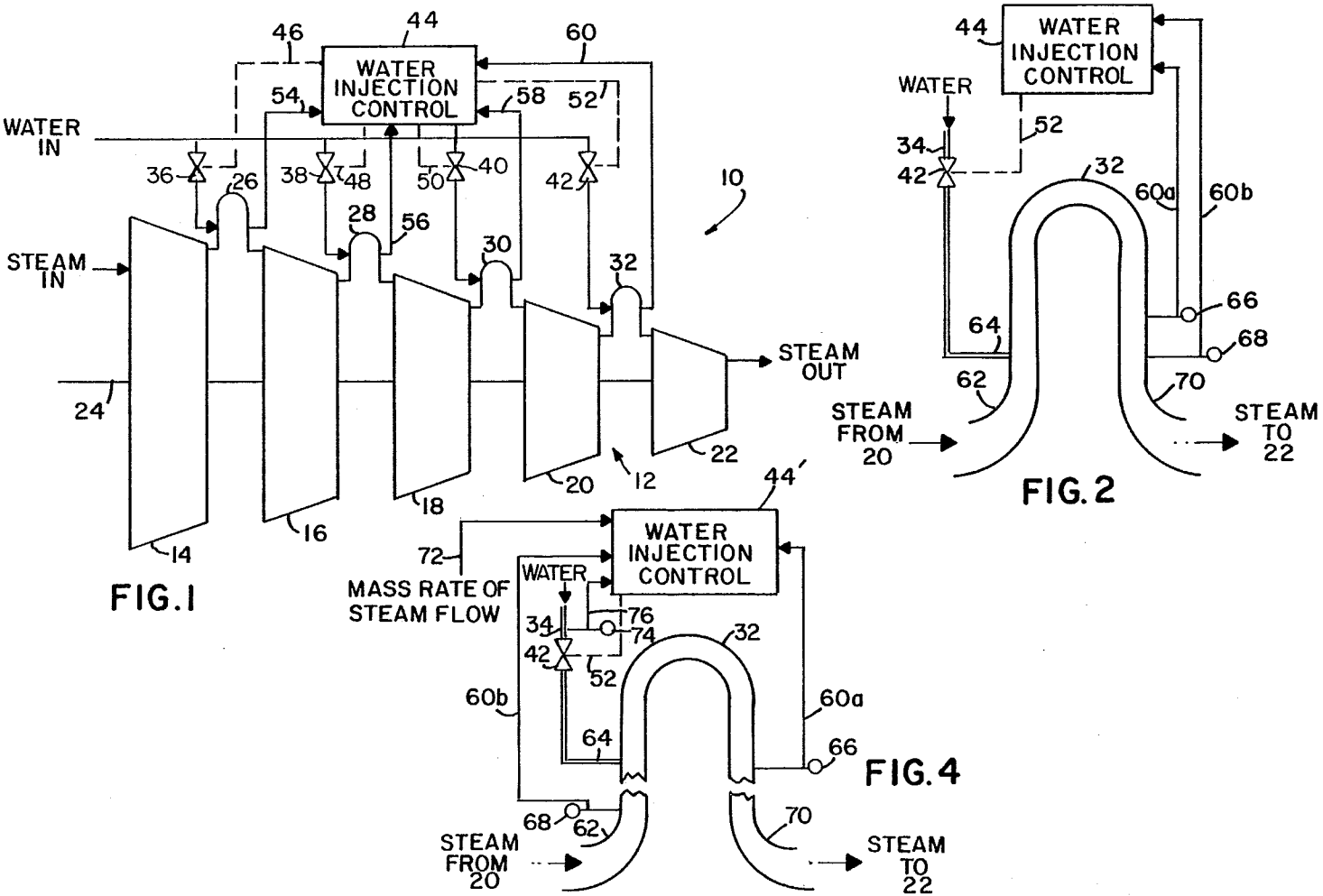
FIG. 1 is a simplified schematic view of a multi-stage compressor including a water injection control according to an embodiment of the invention.
FIG. 2 is a simplified schematic view of a single water injection stage of the apparatus of FIG. 1.
FIG. 4 is a simplified schematic view of a further embodiment of the invention.

DETAILED DESCRIPTION OF THE PREFERRED EMBODIMENT referring to FIG. 1, there is shown, generally at 10, a turbocompressor system according to an embodiment of the invention. A turbocompressor 12 includes a plurality of stages 14, 16, 18, 20 and 22 driven by a prime mover (not shown) through a common shaft 24. The representation of turbocompressor 12 in FIG. 1 is highly schematic and the stages 14–22 are shown separated from each other for clarity of description. In an actual turbocompressor 12, stages 14–22 are enclosed in a common housing (not shown).

Interstage conduits 26, 28, 30 and 32 conduct the compressed fluid from their respective preceding to their succeeding stages. Injection liquid is supplied on a header 34 to a set of control valves 36, 38, 40 and 42 respectively feeding a controlled supply of liquid to interstage conduits 26, 28, 30 and 32. A preferred embodiment of this invention includes a steam compressor with water injection. However, any suitable compressible and compatible injection liquid may be used without departing from the intended scope of the claimed invention. A water injection control 44 provides individual mechanical control of control valves 36, 38, 40 and 42 as indicated by dashed control lines 46, 48, 50 and 52.

Transducers (not shown in FIG. 1) associated with each of interstage conduits 26, 28, 30 and 32 provide water injection control 44 with information concerning a pressure and at least one temperature in each of interstage conduits 26, 28, 30 and 32. The temperature and pressure information is applied on lines 54, 56, 58 and 60 to water injection control 44. Water injection control 44, using its pressure and temperature inputs, positions control valves 36, 38, 40 and 42 to valve settings which appropriately cool the steam fed to their following stages.

Water injection control for interstage cooling between each pair of stages in the embodiment of the invention shown in FIG. 1 is identical. Thus, for simplicity in the descriptions which follow, detailed description is limited to control of water injection for interstage cooling between stage 20 and stage 22.

Referring now to FIG. 2, interstage conduit 32 receives injection water at an upstream end 62 adjacent stage 20 on a conduit 64. A pressure sensor 66 and a temperature sensor 68 at a downstream end 70 of interstage conduit 32 produce pressure and temperature signals respectively which are communicated to water injection control 44 on lines **60*a* and line 60*b***.

The saturation temperature of steam is uniquely determined by its pressure. In operation, water injection control 44 employs the pressure signal produced by pressure sensor 66 to determine the saturation temperature of the steam at the measurement location. Water injection control 44 then calculates a target temperature sufficiently higher than the saturation temperature such that substantially complete vaporization of the injected water can take place in the relatively short path from upstream end 62 to downstream end 70. Then water injection control 44 positions control valve 42 via mechanical control 52 to inject a flow of water through conduit 64 sufficient to maintain the temperature measured by temperature sensor 68 at a value substantially equal to the target temperature. The target temperature chosen depends on the geometry of the particular turbocompressor 12 in which it is used, the closeness of control which may be expected and the particular operating conditions of the stages which precede and follow it. The target temperature is preferably in the range of from about 20 to about 100 degrees F. and most preferably from about 50 to about 70 degrees F. above saturation temperature.

Figure 3:
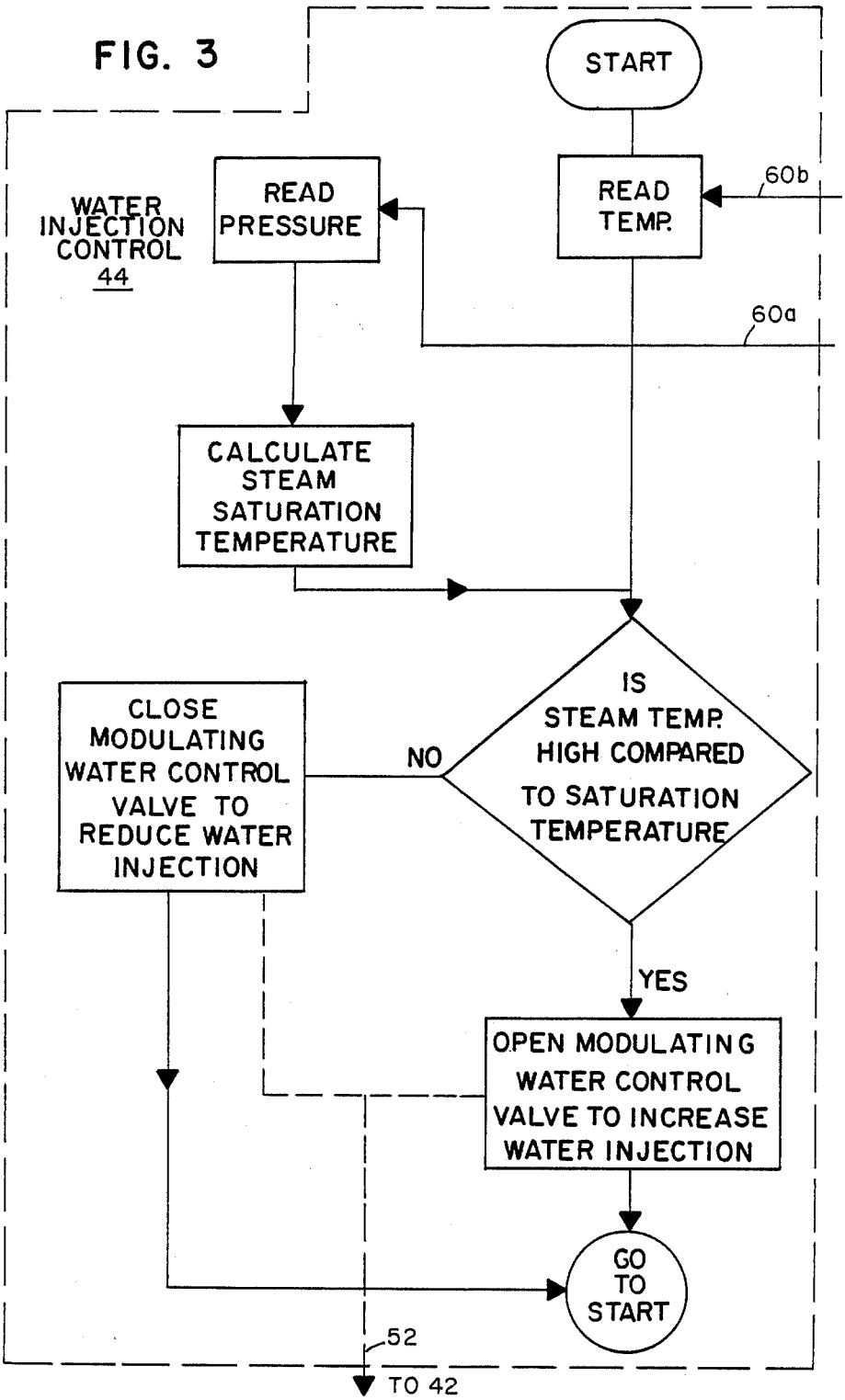
FIG. 3 is a flow diagram showing one sequence in which the water injection control of FIG. 2 may be implemented.

Water injection control 44 may be implemented in any convenient hardware such as, for example, in analog or digital circuit using discrete components or integrated circuits. Water injection control 44 preferably includes a digital computer and most preferably includes a microprocessor operative to receive the signals on line 60*a* and line 60*b* and to produce a valve-control signal on mechanical control 52. One possible implementation of water injection control 44 is shown in the flow chart of FIG. 3 which performs the functions hereinabove described. The determination of saturation temperature based on measured pressure may be performed in any convenient manner including, for example, a stored look-up table or a calculated factor based on conventional steam tables.

Referring now also to FIG. 2, a water flow sensor (not shown) may be employed in header 34 or conduit 64 as a safety device to detect a water flow exceeding a reasonable value based on the saturation temperature derived from the steam pressure in water injection control 44. If such unreasonable flow is detected, water injection control 44 may include means (not shown) for producing an override signal effective to close control valve 42 and optionally to also produce an alarm signal to alert the operator to the existence of this condition.

In the apparatus of FIG. 2, although substantially complete vaporization of the injected water is accomplished and all large water droplets capable of pitting and eroding the impeller blades of the downstream stage are eliminated, a residue of very fine droplets passing temperature sensor 68 may be unavoidable. If a conventional temperature probe is exposed to the steam flow in interstage conduit 32 at downstream end 70, the fine droplets may contact the temperature probe. Since the steam passing temperature sensor 68 is superheated, it is capable of absorbing additional moisture. That is, the steam is capable of evaporating the water film from the temperature probe and thus reducing its temperature. The temperature signal produced by temperature sensor 68 under this situation is reduced by evaporative cooling to the wet-bulb temperature rather than the true or dry-bulb temperature at downstream end 70.

In order to avoid inaccuracies resulting from evaporative cooling on temperature sensor 68, an aspirator-type temperature sensor may be used for temperature sensor 68. An aspirator-type temperature withdraws a sample of the medium whose temperature is to be measured and rejects the water from the sample by, for example, passing the sample through a labyrinthine path before exposing it to a temperature probe. An aspirator-type temperature sensor is a relatively expensive device and its use therefore adds to the cost of the system. One vendor for such aspirator sensor is United Sensor and Control Corp., Waltham, Mass.

Referring now to FIG. 4, an embodiment of the invention is shown which eliminates the need for an aspirator-type temperature sensor 68 at the cost of slightly increased computational complexity in water injection control 44' and the need for at least one additional input signal. Temperature sensor 68 is relocated from downstream end 70 to upstream end 62 upstream of the injection point for water injection. Thus, temperature sensor 68 is exposed only to strongly superheated steam without water droplets which could interfere with measurement accuracy. In this embodiment, however, water injection control 44' must receive a signal related to the mass rate of steam flow passing through turbocompressor 12 at the point of interest in order to calculate the amount of water which must be injected based on both the pressure and the mass rate of steam flow. This additional quantity is shown provided on a line 72. The signal on line 72 may be produced by any conventional measuring device (not shown). In most large practical systems, the mass rate of steam flow at least at the inlet of turbocompressor 12 is conventionally measured so that the signal needed on line 72 is normally already available.

If the valve characteristic of control valve 42 is accurately known, and if the pressure head on header 34 and the pressure in interstage conduit 32 are constant, the water flow produced through control valve 42 is completely determined. These ideal conditions do not usually occur in practice so that water flow through header 34 is preferably measured by a flow meter 74 to provide a water flow signal on a line 76 to water injection control 44'.

Figure 5:
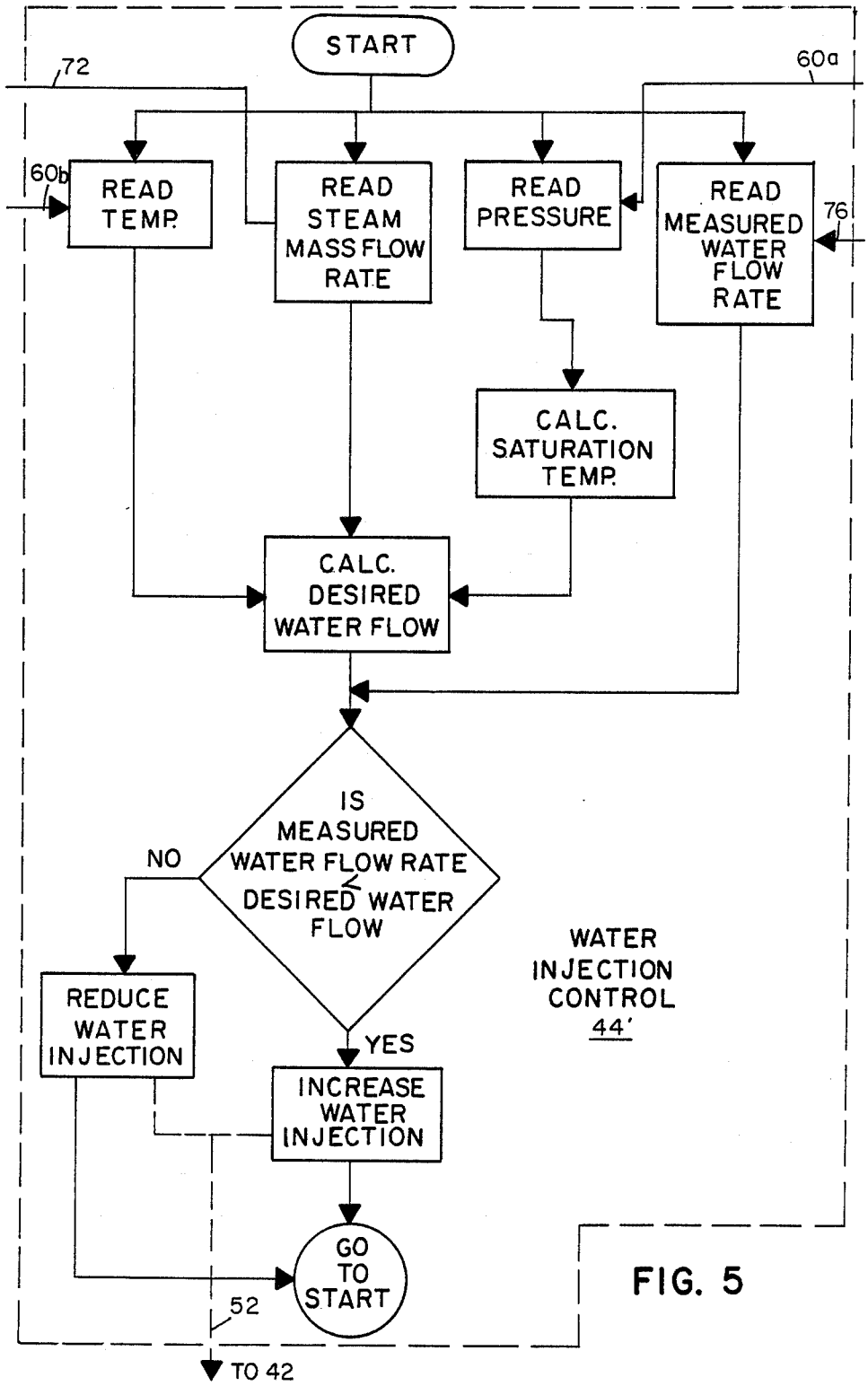
FIG. 5 is a flow diagram showing one sequence in which the water injection control of FIG. 4 may be implemented.

In operation, the embodiment of the invention in FIG. 4 calculates the saturation temperature of the steam in interstage conduit 32 based on the pressure measured by pressure sensor 66 and then calculates the flow rate of water required to reduce the temperature of the steam measured by temperature sensor 68 upstream of the water injection point to a value which is a predetermined amount above the pressure-derived steam saturation temperature based on the calculated saturation temperature, the measured temperature and the steam mass flow rate. This desired water flow rate is compared with the measured (if flow meter 74 is provided) or inferred (if valve characteristic and valve position are relied on) water flow rate to determine whether control valve 42 should be incrementally opened or closed. A flow diagram of a program which may be suitable for implementing this embodiment in water injection control 44' is shown in FIG. 5. This flow diagram may, of course, be implemented by any convenient analog or digital device but is preferably implemented in a microprocessor.

The principal difference between the embodiments of FIGS. 2 and 4 lies in the manner in which the control loop is closed to obtain closed loop control of the water injection. In the embodiment of FIG. 2, the measured temperature at downstream end 70 closes the loop to determine whether water injection is the proper volume. A knowledge of steam mass flow rate is not required for this embodiment. In the embodiment of FIG. 4, the measured water flow rate closes the loop to determine whether the flow rate of water corresponds to the flow rate calculated on the basis of measured parameters. A knowledge of steam mass flow rate is required for this embodiment. In addition, the embodiment of FIG. 4 is, in a sense, an open loop system since the element closing the feedback loop is not responsive to a measured value of the desired result (temperature at downstream end 70), but instead is responsive only to input parameters. A further embodiment (not illustrated) may employ a hybrid of the embodiments of FIGS. 2 and 4 wherein a temperature measurement at control valve 42 may be employed in addition to the measured injection water flow to close the loop and maintain the temperature at downstream end 70 at the desired value.

It should be reiterated that the embodiments of the invention shown in FIGS. 2–5 represent only one of a plurality of interstage water injection controls 44, one for each succeeding pair of stages. The superheating thresholds and control parameters would clearly vary from stage to stage, but one skilled in the art would be capable of determining the precise values for a particular installation with no experimentation whatsoever. Thus, additional details of such values are omitted as superfluous. One water injection control 44 may be shared between all water injection stages if desired and this is, in fact, the preferred embodiment.

The measured value of steam mass flow rate conventionally available is the value at the inlet of turbocompressor 12. Water injection adds about 3 percent of additional mass flow per water injection stage. Thus, in a turbocompressor 12 having, for example, six compressor stages and five stages of interstage water injection, the four water injection stages preceding the fifth water injection stage has cumulatively increased the mass flow rate by about 12 percent. This error in mass flow rate may be great enough to require inclusion in the computation. Such inclusion is readily done by adding the mass flow rate of water injected at each water injection stage to the mass flow rate signal used by the next succeeding water injection stage.

Although not shown in the figures, a desuperheater may be added at the outlet of turbocompressor 12 if required to further reduce the superheat of the steam delivered from turbocompressor 12 to succeeding processes.

Although the benefits of the present invention are particularly great when applied to interstages between all pairs of succeeding stages of a multi-stage compressor, it should not be considered that employing a water injection control in accordance with the present invention to less than all of the interstages of a multi-stage compressor departs from the spirit and scope of the invention.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. Apparatus for controlling interstage liquid injection into a fluid flowing in a multi-stage compressor, comprising:

means for measuring a fluid pressure in said interstage;

means for calculating a saturation temperature of said fluid based on said fluid pressure and, control means effective to control a flow rate of said liquid injection at an upstream end to a value which reduces a temperature of said fluid at a downstream end of said interstage to a predetermined amount above said saturation temperature.

2. Apparatus in accordance with claim 1 wherein the liquid is water and the fluid is steam.

3. Apparatus for controlling interstage water injection according to claim 2 wherein said control means includes a temperature sensor at said downstream end effective to produce a temperature signal related to said temperature of said steam at said downstream end, and means for controlling a flow rate of said water injection in dependence upon a relationship between said temperature signal and said predetermined amount.

4. Apparatus for controlling interstage water injection according to claim 3 wherein said temperature sensor is of a type substantially unaffected by a residue of liquid water droplets in said interstage.

5. Apparatus for controlling interstage water injection according to claim 4 wherein said temperature sensor is an aspirator-type temperature sensor.

6. Apparatus for controlling interstage water injection according to claim 2 wherein said means for calculating a saturation temperature includes a lookup table in a digital computer.

7. Apparatus for controlling interstage water injection according to claim 2 wherein said control means includes a temperature sensor effective to produce a temperature signal related to a temperature of said steam in said interstage upstream of said water injection, means responsive to said temperature signal, the calculated saturation temperature and a mass rate of steam flow in said multi-stage compressor to calculate a desired rate of water injection to reduce a temperature of said steam to said predetermined amount above said saturation temperature, and means for controlling an actual rate of water injection to a value substantially equal to said desired rate of water injection.

8. Apparatus for controlling interstage water injection according to claim 7 wherein said means for controlling an actual rate includes means for comparing said actual rate and said desired rate and means for increasing and decreasing said actual rate in dependence on the comparison.

9. A method for controlling interstage water injection into a steam flowing in a multi-stage compressor, comprising:

measuring a pressure of steam in said interstage;

calculating a saturation temperature of said steam based on said pressure; and controlling a flow rate of said water injection at an upstream end to a value effective to reduce a temperature of said steam at a downstream end of said interstage to a predetermined amount above said saturation temperature.

* * * * *